United States Patent [19]

Bartholic

[11] 4,427,538

[45] Jan. 24, 1984

[54] SELECTIVE VAPORIZATION PROCESS AND APPARATUS

[75] Inventor: David B. Bartholic, Watchung, N.J.

[73] Assignee: Engelhard Corporation, Edison, N.J.

[21] Appl. No.: 299,361

[22] Filed: Sep. 4, 1981

Related U.S. Application Data

[63] Continuation-in-part of Ser. No. 155,736, Jun. 2, 1980, Pat. No. 4,328,091, which is a continuation-in-part of Ser. No. 90,247, Nov. 1, 1979, Pat. No. 4,263,128, which is a continuation-in-part of Ser. No. 875,326, Feb. 6, 1978, abandoned.

[51] Int. Cl.[3] ..... C10G 9/32; F27B 15/00; B01J 8/24

[52] U.S. Cl. ..... 208/127; 208/157; 208/251 R; 422/144

[58] Field of Search ..... 208/127, 157, 251 R, 208/161; 422/144, 145, 147

[56] References Cited

U.S. PATENT DOCUMENTS

| | | | |
|---|---|---|---|
| 2,571,342 | 10/1951 | Crowley | 196/49 |
| 2,671,102 | 3/1954 | Jewell | 208/161 X |
| 2,734,021 | 2/1956 | Martin et al. | 196/49 |
| 2,863,823 | 12/1958 | Moser, Jr. | 208/251 R |
| 2,872,411 | 2/1959 | Krebs et al. | 208/157 |
| 2,908,030 | 10/1959 | Friedman | 208/157 X |
| 2,908,630 | 10/1959 | Friedman | 208/157 X |
| 2,911,353 | 11/1959 | Watts et al. | 208/88 |
| 2,943,040 | 6/1960 | Weisz | 208/91 |
| 3,607,127 | 9/1971 | Pfeiffer | 208/164 |
| 4,066,533 | 1/1978 | Myers et al. | 55/1 X |
| 4,070,159 | 1/1978 | Meyers et al. | 422/147 |
| 4,313,910 | 2/1982 | Dries et al. | 422/147 |
| 4,328,091 | 5/1982 | Bartholic | 208/157 X |

FOREIGN PATENT DOCUMENTS 778220 7/1957 United Kingdom .

*Primary Examiner*—Delbert E. Gantz
*Assistant Examiner*—Glenn A. Caldarolo
*Attorney, Agent, or Firm*—Inez L. Moselle

[57] ABSTRACT

An improvement is disclosed on selective vaporization for decarbonizing and demetallizing heavy petroleum stocks by short time contact with hot inert solid contact material. Flexibility is imparted to that process by suspending the contact material in steam or other carrier gas and adding the heavy petroleum stock at variable levels in the selective vaporization contactor.

11 Claims, 2 Drawing Figures

SELECTIVE VAPORIZATION PROCESS AND APPARATUS

CROSS REFERENCE TO RELATED APPLICATIONS

This application is a continuation-in-part of application Ser. No. 155,736, filed June 2, 1980, which issued as U.S. Pat. No. 4,328,091 on May 4, 1982, which is a continuation-in-part of application Ser. No. 090,247, which issued as U.S. Pat. No. 4,263,128 on Apr. 21, 1981 and which was filed Nov. 1, 1979 as a continuation-in-part of application Ser. No. 875,326, filed Feb. 6, 1978 now abandoned.

BACKGROUND OF THE INVENTION

The invention is concerned with increasing the portion of heavy petroleum crudes which can be utilized as catalytic cracking feed stock to produce premium petroleum products, particularly motor gasoline of high octane number, or as high quality heavy fuel. The heavy ends of many crudes are high in Conradson Carbon (sometimes reported as Ramsbottom Carbon) and metals which are undesirable in catalytic cracking feed stocks and in products such as heavy fuel. The present invention provides an economically attractive method for selectively removing and utilizing these undesirable components from whole crudes and from the residues of atmospheric and vacuum distillations, commonly called atmospheric and vaccum residua or "resids". The terms "residual stocks", "resids" and similar terminology will be used here in a somewhat broader sense than is usual to include any petroleum fraction remaining after fractional distillation to remove some more volatile components. In that sense "topped crude" remaining after distilling off gasoline and lighter is a resid. The undesirable CC (for Conradson Carbon) and metal bearing compounds present in the crude tend to be concentrated in the resids because most of them have low volatility. The terms "Conradson Carbon" and "Ramsbottom Carbon" have reference to the two most used tests for this undesirable constituent. Some difference in numerical values by the two tests may be found for the same sample, but generally the test results from either are indicative of the same characteristic.

When catalytic cracking was first introduced to the petroleum industry in the 1930's the process constituted a major advance in its advantages over the previous technique for increasing the yield of motor gasoline from petroleum to meet a fast growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present day status in which the catalytic cracker is the dominant unit, the "workhouse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely affected.

Quality of heavy fuels such as Bunker Oil and heavy gas oil is also increasingly affected as it becomes necessary to prepare these from crudes of high CC, metals and salt contents.

The effect of higher Conradson Carbon in catalytic cracking is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottle-neck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. Excessive hydrogen also raises a bottle-neck problem. The lighter ends of the cracked product, butane and lighter, are processed through fractionation equipment to separate components of value greater than fuel to furnaces, primarily propane, butane and the olefins of like carbon number. Hydrogen, being incondensable in the "gas plant" occupies space as a gas in the compression and fractionation train and can easily overload the system when excessive amounts are produced by high metal content catalyst, causing reduction in charge rate to maintain the FCC Unit and auxiliaries operative.

In heavy fuels, used in stationary furnaces, turbines, marine and large stationary diesel engines quality is a significant factor. For example, petroleum ash, particularly vanadium and sodium, attacks furnace refractories and turbine blades.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780°-840° F. During the long residence time at this temperature, the charge is converted to coke and distillate products taken off the top of the drum for recovery of "coker gasoline", "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge. Higher temperature coking for production of olefinic products is described in Beuther, et al. U.S. Pat. No. 2,874,092 where volatile products are promptly removed from the coking reactor to inhibit secondary reactions.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking or blending with other fractions for fuels. Coking does reduce metals and Conradson Carbon, but still leaves an inferior gas oil for charge to catalytic cracking.

Catalytic charge stock and fuel stocks may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica gel is proposed by Shuman and Brace, Oil and Gas Journal, Apr. 6, 1953, page 113. See also U.S. Pat. Nos. 2,378,531, 2,462,891 and 2,472,723, cited in the said parent application Ser. No. 875,326, filed Feb. 6, 1978.

The above noted U.S. Pat. Nos. 2,462,891 (Noll) and 2,378,531 (Becker) utilize a solid heat transfer medium to vaporize and preheat catalytic cracking charge stock utilizing heat from a catalytic regenerator. The intent of those patentees is to vaporize the total quantity of a catalytic charge stock, although it is recognized that a heavy portion of the charge may remain in liquid state and be converted to vaporized products of cracking and coke by prolonged contact with the heat transfer material, a conversion related to the coking processes earlier noted.

U.S. Pat. No. 2,472,723 proposes the addition of an adsorptive clay to the charge for a catalytic cracking process. The clay is used on a "once-through" basis to adsorb the polynuclear aromatic compounds which are believed to be coke precursors and thus reduce the quantity of coke deposited on the active cracking catalyst also present in the cracking zone.

It is known to use solid heat transfer agents to induce extensive cracking of hydrocarbon charge stocks at the high temperatures and short reaction times which maximize ethylene and other olefins in the product. An example of such teachings is U.S. Pt. No. 3,074,878 to Pappas.

SUMMARY OF THE INVENTION

The invention is an improvement on the selective vaporization process and apparatus described in application Ser. Nos. 875,326, filed Feb. 6, 1978, now abandoned; 090,247, filed Nov. 1, 1979, which issued as U.S. Pat. No. 4,263,128 on Apr. 21, 1981; 144,477, filed Apr. 28, 1980, which issued as U.S. Pat. No. 4,311,580 on Jan. 19, 1982 and 155,736, filed June 2, 1980, which issued as U.S. Pat. No. 4,328,091 on May 4, 1982.

Briefly, the selective vaporization process is conducted by contacting a heavy charge stock such as whole crudes, topped crudes, resids and the like with an inert, finely divided solid material in a confined vertical column under conditions to deposit heavy components of high CC and/or metal content on the solid and vaporize other components of the charge. This results from temperatures high enough to cause the desired vaporization and very short hydrocarbon residence times to avoid substantial cracking. The operation is thus held to a low cracking severity to accomplish the desired purpose of separating vaporizable, more valuable components from those which are regarded as contaminants. Steam, light hydrocarbons or the like are added to the rising confined column in the selective vaporization facility to reduce partial pressure of hydrocarbons in the charge and thus aid in vaporization.

Vaporous hydrocarbons are separated at the top of the column from inert solids bearing the unvaporized components as a deposit thereon. The vapors are promptly cooled to a temperature below that at which substantial thermal cracking occurs and processed as desired in a catalytic cracker or the like.

According to certain embodiments of the invention, the contact is conducted in a riser. In other embodiments, a rising column of inert solids in steam, hydrocarbon gases or both is established and the direction of flow is reversed to a confined descending column into which the charge is injected.

The separated inert solids bearing the deposit of unvaporized components of the charge are transferred to a burner for combustion of the deposit in air or other oxygen containing gas. Heat generated by combustion of the deposit raises the temperature of the inert solids which are then returned to the lower portion of the rising confined column to supply the heat for selective vaporization of additional heavy charge.

The present invention provides a process and an apparatus for varying the hydrocarbon residence time in the confined column which defines the contactor in which selective vaporization is conducted. That result is accomplished by providing a plurality of points for injection of charge stock to the selective vaporization contactor to compensate for changes in quantity or quality of feed stock.

DESCRIPTION OF THE DRAWINGS

Apparatus suited to practice of the invention is illustrated diagrammatically in FIG. 1 of the annexed drawings.

DESCRIPTION OF SPECIFIC EMBODIMENTS

Figure 1:
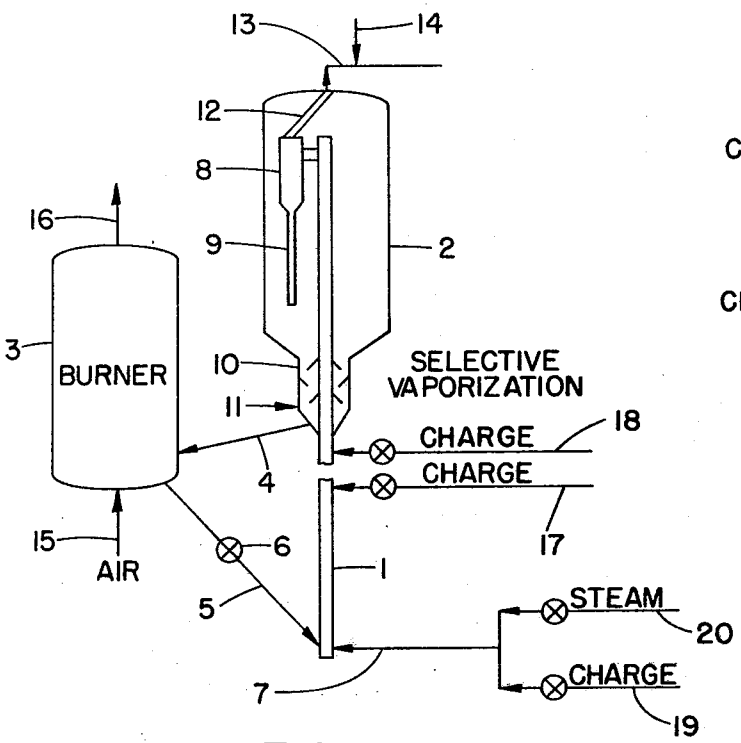

As shown in FIG. 1, the principal vessels used are a riser 1 for conducting the short time, high temperature contact between hot inert solids and charge stock which terminates in a disengaging chamber 2 from which inert solids bearing a deposit of unvaporized material are transferred to a burner 3 by standpipe 4. The hot inert solids resulting from combustion in burner 3 are returned to the base of riser 1 by a standpipe 5 through a control valve 6.

A charge stock containing high boiling components which are characterized by high CC, metals content or both is admitted to the riser 1 by line 7 to rise at high velocity in riser 1 while in intimate contact with the hot inert solids from standpipe 5. The major portion of the charge stock is vaporized at the temperature prevailing in the riser by reason of the hot solids from standpipe 5. That vaporization is extremely rapid to result in a rapidly rising column of vapor with inert solids suspended therein. The portions of the charge which are not vaporized coalesce on the inert solids to provide a combustible deposit constituted primarily by feed stock components of high CC and metals content.

The solids are separated from the vaporous hydrocarbons at the top of riser 1 by any of the systems developed for the same purpose in the well-known FCC process for riser cracking of hydrocarbons in the presence of an active cracking catalyst. A system of preference in the present invention is the vented riser described in Meyers, et al. U.S. Pat. Nos. 4,066,533 and 4,070,159. The upper end of riser 1 is open whereby inertia of the suspended solids causes them to be projected into the vessel 2. Vapors leave the riser through a side vent in the riser to cyclone separator 8 where solids still suspended in the vapors are removed and discharged by dipleg 9 to the lower porton of vessel 2. The solids projected from the top of riser 2 and those from dipleg 9 pass downwardly to a stripper 10 where steam from line 11 aids in vaporization of any remaining volatile hydrocarbons before the solids bearing combustible deposit enter standpipe 4 for transfer to burner 3.

The vapors separated from entrained solids in cyclone 8 pass by conduit 12 to transfer line 13 where the vapors are cooled to a temperature below that at which substantial thermal cracking occurs as by mixture with a suitable quench medium such as a cold hydrocarbon stream or water.

The burner 3 may be any of the various structures developed for burning of combustible deposits from finely divided solids, for example, the regenerators for Fluid Cracking Catalyst. Air admitted to the burner 3 by line 15 provides the oxygen for combustion of the deposit on the inert solid, resulting in gaseous products of combustion discharged by flue gas outlet 16. The burner 3 is preferably operated to maintain the temperature in the burner at the maximum value, usually limited by metallurgy of the burner. This is accomplished by controlling temperature of the riser 1 to the minimum temperature which will provide the amount of fuel (as deposit on the inert solids) which will sustain the maximum temperature of the burner. As is common in heat balanced FCC Units, valve 6 is controlled responsive to the temperature at the top of riser 1 in a manner to maintain the riser temperature at a preset value. That preset temperature is reset as needed in selective vaporization to maintain a desired maximum temperature in burner 3. A trend to lower temperature in burner 3 is compensated by reduction of the preset temperature of riser 1, and vice versa. Inert solids heated by the combustion in burner 3 are stripped with steam in the burner 3 or the standpipe 5 before being returned to riser 1.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27 API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other suitable inert solids include, in general, any solid which satisfies the stated criteria.

The microspheres of calcined kaolin clay preferably used in the process of the invention are known in the art and are employed as a chemical reactant with a sodium hydroxide solution in the manufacture of fluid zeolitic cracking catalysts as described in U.S. Pat. No. 3,647,718 to Haden et al. In practice of the instant invention, in contrast, the microspheres of calcined kaolin clay are not used as a chemical reactant. Thus the chemical composition of the microspheres of calcined clay used in practice of this invention corresponds to that of a dehydrated kaolin clay. Typically, the calcined microspheres analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally, iron content (expressed as $Fe_2O_3$) is about ½% by weight and titanium (expressed as $TiO_2$) is approximately 2%.

The microspheres are preferably produced by spray drying an aqueous suspension of kaolin clay. The term "kaolin clay" as used herein embraces clays, the predominating mineral constituents of which are kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength.

While it is preferable in some cases to calcine the microspheres at temperatures in the range of about 1600° F. to 2100° F. in order to produce particles of maximum hardness, it is possible to dehydrate the microspheres by calcination at lower temperatures; for example, temperatures in the range of 1000° F. to 1600° F., thereby converting the clay into the material known as "metakaolin". After calcination the microspheres should be cooled and fractionated, if necessary, to recover the portion which is in the desired size range, say 20–150 microns.

Pore volume of the microspheres will vary slightly with the calcination temperature and duration of calcination. Pore size distribution analysis of a representative sample obtained with a Desorpta analyzer using nitrogen desorption indicates that most of the pores have diameters in the range of 150 to 600 Angstrom units.

The surface area of the calcined microspheres is usually within the range of 10 to 15 $m^2/g$. as measured by the well-known B.E.T. method using nitrogen absorption. It is noted that the surface areas of commercial fluid zeolitic catalysts is considerably higher, generally exceeding values of 100 $m^2/g$. as measured by the B.E.T. method.

Although the system just described bears superficial resemblance to an FCC Unit, its operation is very different from FCC. Most importantly, the riser contactor 1 is operated to remove from the charge an amount not greatly in excess of the Conradson Carbon number of the feed. This contrasts with normal FCC "conversion" of 50–70%, measured as the percentage of FCC product not boiling within the range of the charge. Percent removed by the present process is preferably on the order of 10% to 20% on charge and constituted by gas, gasoline and deposit on the solid contacting agent.

Rarely will the amount removed as gas, gasoline and deposit on the inert solid exceed a value, by weight, more than 3 to 4 times the Conradson Carbon value of the charge. This result is achieved by a very low severity of cracking due to inert character of the solid and the very short residence time at cracking temperature. As is well known, cracking severity is a function of time and temperature. Increased temperature may be compensated by reduced residence time, and vice versa.

The new process affords a control aspect not available to FCC Units in the supply of hydrocarbons or steam to the riser contactor. When processing stocks of high CC, the burner temperature will tend to rise because of increased supply of fuel to the burner. This may be compensated by increasing the hydrocarbons or steam supplied to reduce partial pressure of hydrocarbons in the riser contactor or by recycling water from the overhead receiver to be vaporized in the riser to produce steam.

The riser contact with inert solid thus provides a novel sorption technique for removing the polynuclear aromatic compounds of resids (high CC and metals) while these are carried in a stream of low hydrocarbon partial pressure by reason of hydrocarbons or steam supplied to the riser.

The decarbonized, desalted and/or demetallized resid is good quality FCC charge stock and may be transferred to the feed line of an FCC reactor operated in the conventional manner.

It is found that the nature of the selective vaporization is a function of temperature, total pressure, partial pressure of hydrocarbon vapors, residence time, charge stock and the like. One effect of temperature is a tendency to decrease the combustible deposit on the contact material as contact temperature is increased. Thus greater portions of the charge are vaporized at higher temperatures and the secondary effect of thermal cracking of deposited hydrocarbons increases at higher temperatures. These effects of higher temperature enhance the yield of product from the operation and reduce the fuel supplied to the combustion zone in the form of combustible deposit.

In general, the temperature of selective vaporization will be above the average boiling point of the charge stock, calculated as the sum of the 10% to 90% points by ASTM distillation of the charge divided by nine. For the heavy stocks contemplated by the invention, the contact temperature will usually be not substantially below 900° F. and will be below the temperatures at which severe cracking occurs to produce large yields of olefins. Thus even at residence times as short as 0.1 second or less, selective vaporization temperatures will be below about 1050° F.

Residence time for selective vaporization is not accurately calculated by the methods generally used in FCC cracking where the volume of vapors increases to a major extent as the hydrocarbons remain in contact with an active cracking catalyst along the length of a riser. In selective vaporization, the vapors are quickly generated on contact with the hot inert solid and remain substantially constant in composition along the length of the riser, increasing slightly with modest thermal cracking believed to be cracking of the deposit on the inert solid. Residence time of hydrocarbons in selective vaporization is therefore calculated with reasonable accuracy as the length of the riser from point of hydrocarbon injection to point of disengagement from inert solids divided by superficial velocity of vapors (hydrocarbons, steam, etc.) at the top of the riser. So calculated, hydrocarbon residence time in selective vaporization will be not substantially greater than about 3 seconds and is preferably much shorter, one second or less, such as 0.1 second. As previously indicated, residence time and temperature will be correlated to provide conditions of low cracking severity. The quantity removed from the charge is very nearly equal to CC value of the charge when operating under preferred conditions and will rarely exceed a value 3 to 4 times the CC of the charge. Further, the hydrogen content of the deposit is about 3% to 6%, below the 7–8% normal in FCC coke.

The invention provides a means to vary hydrocarbon residence time while maintaining charge rate constant or to maintain a constant residence time at reduced charge rate. It will be apparent that the invention also provides other flexibilities for the process, i.e., residence times and/or charge rates may be varied without holding either at constant levels.

That effect results from use of a riser 1 which has multiple injection points along the length thereof. When hydrocarbon feed is injected at a point above the bottom of the riser, an inert gas is injected at the bottom of the riser to carry the inert solids upwardly to the region of hydrocarbon injection. That inert gas also serves the function of reducing hydrocarbon partial pressure above the point of hydrocarbon injection, thus promoting selective vaporization. The inert gas is preferably supplied as steam or water but may be any gas which will not undergo substantial reaction at the conditions prevailing in the riser. Thus the process may use nitrogen as the lift gas or may use a hydrocarbon which will not undergo substantial thermal cracking at the riser conditions. Methane and other light hydrocarbons which boil below about 450° F. are preferred examples of such materials.

As shown in FIG. 1, the riser 1 is provided with injection means to supply charge from valved lines 17 and 18 which may be conveniently spaced at 25% and 50% of the height of riser 1, respectively. In a riser so modified, injection line 7 at the bottom of the riser is provided with valved lines 19 and 20 for supply of steam or other recycle materials such as sour water, recycle gas or hydrocarbon liquids to the bottom of riser 1 with or without hydrocarbon charge stock.

Figure 2:
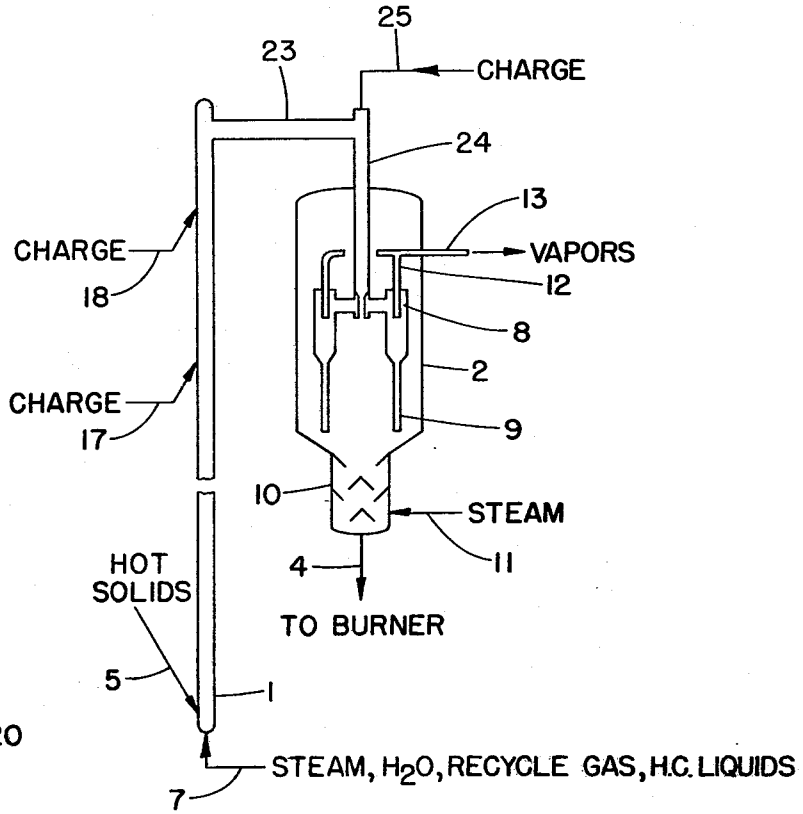
FIG. 2 represents an embodiment in which the charge is injected to a descending column produced by reversing direction of flow of a stream of suspended inert solids which is initially established as a rising column.

In the embodiment of FIG. 2 the flow in riser contactor 1 is reversed to enter the vessel 2 by downward flow through the top of vessel 1. Various structures for that purpose have been designed for parallel use in the FCC process, such as cyclone separators as generally discussed in column 4, lines 42–59 of the above-cited Myers, et al. U.S. Pat. No. 4,070,159. As shown in FIG. 2, a column of rising hot inert solids is established in riser contactor 1 by injecting steam, liquid water, recycle gas or stable light hydrocarbon liquid to the bottom of the riser by line 7 to mix with and suspend hot inert solids added by standpipe 5 from the burner. Charge residual fractions may be added at points along riser 1 from lines 17 and 18 as in FIG. 1. At the highest point of riser 1, flow is directed horizontally through portion 23 of the contactor and then downwardly through vertical section 24 to the open end of the contactor with diversion of vapors to cyclones 8.

Significant advantages are realized by adding some or all of the charge to the upper end of contactor section 24. Extremely short contact times characterize this embodiment. In addition, the force of gravity on the inert solid does not induce the "slippage" which causes the inert solid to have a longer residence time in the contactor than does the hydrocarbon vapor generated by contact of charge stock with hot inert solids in the embodiment of FIG. 1. With some types of residual fractions, it will be found that best results are achieved by injecting the total charge by line 25 to the downwardly directed section 24 of the contactor 1. In that type of operation, the riser portion of the contactor serves to establish the suspension of hot inert solids in the gaseous medium which also acts to reduce partial pressure of hydrocarbon vapors produced by contacting the residual fraction charge with hot inert solids.

This system allows the operator increased flexibility in the conduct of selective vaporization. Taken with the flexibility inherent in ability to vary the ratio between charge and steam, a unit can be operated over a wide range of charge stocks and residence time to adapt the operation to changes in quantity and/or quality of charge available.

I claim:

1. In a selective vaporization process for decarbonizing and demetallizing heavy petroleum fractions by contacting such fraction and an inert gas for reduction of the partial pressure of vaporous products of said contacting with a finely divided inert solid contact material at low cracking severity conditions of high temperature and short hydrocarbon residence time in a confined conduit, separating the vaporous products of said contacting from said contact material bearing a combustible deposit of unvaporized high Conradson Carbon or high metal content constituents of said petroleum fraction, cooling said vaporous products to a temperature below that at which substantial thermal cracking occurs, contacting said separated contact material with an oxidizing gas to burn said combustible deposit and heat the contact material to high temperature and returning the so heated contact material to the lower portion of said confined conduit for renewed contact with said heavy petroleum fraction; the improvement providing flexibility in rate of charging said fraction, or in control of said residence time or both which comprises establishing a rising confined column of said solid contact material in said inert gas at the lower portion of said confined conduit, and discharging the contact material as a downwardly flowing stream into an enlarged separation zone for conduct of the aforesaid separation of said vaporous products from said contact material, injecting said heavy petroleum fraction to a point in said confined conduit at or downstream of said lower portion and varying said point of injection to vary said residence time, said heavy petroleum fraction being injected at least in part into said downwardly flowing stream.

2. A process according to claim 1 wherein said heavy petroleum fraction is injected only to said downwardly flowing stream.

3. A process according to claims 1, or 2 wherein said inert gas is steam.

4. A process according to claims 1, or 2 wherein said inert gas is hydrocarbon.

5. A process according to claims 1, or 2 wherein said heavy petroleum fraction is a residual fraction.

6. In a selective vaporization process for decarbonizing and demetallizing heavy petroleum fractions by contacting such fraction and an inert gas for reduction of the partial pressure of vaporous products of said contacting with a finely divided inert solid contact material at low cracking severity conditions of high temperature and short hydrocarbon residence time in a confined conduit, separating the vaporous products of said contacting from said contact material being a combustible deposit of unvaporized high Conradson Carbon or high metal content constituents of said petroleum fraction, cooling said vaporous products to a temperature below that at which substantial thermal cracking occurs, contacting said separated contact material with an oxidizing gas to burn said combustible deposit and heat the contact material to high temperature and returning the so heated contact material to the lower portion of said confined conduit for renewed contact with said heavy petroleum fraction; the improvement providing flexibility in the rate of charging said fraction, or in control of said residence time or both which comprises establishing a rising confined column of said solid contact material in said inert gas at the lower portion of said confined conduit, and discharging the contact material as a downwardly flowing stream into an enlarged separation zone for conduct of the aforesaid separation of said vaporous products from said contact material, and injecting said heavy petroleum fraction to a point in said confined conduit at or downstream of said lower portion, said heavy petroleum fraction being injected at least in part into said downwardly flowing stream.

7. A process according to claim 6 wherein said heavy petroleum fraction is injected only to said downwardly flowing stream.

8. A process according to claim 6, or 7 wherein said inert gas is steam.

9. A process according to claim 6, or 7 wherein said inert gas is hydrocarbon.

10. A process according to claim 6, or 7 wherein said heavy petroleum fraction is a residual fraction.

11. Apparatus for selective vaporization of a heavy petroleum fraction comprising a riser contactor in the form of a vertical conduit having a reverse bend at the upper portion to provide a downwardly directed discharge opening, a hot solids standpipe connected to the bottom of said riser contactor for supply thereto of finely divided hot inert solid contact material, means to supply an inert carrier gas to the bottom of said riser contactor to suspend said solid contact material in a rising confined column of gases and contact material in said riser contactor, means to discharge said contact material as a downwardly flowing stream in said downwardly directed discharge opening, a plurality of injection means for the introduction of a heavy petroleum fraction to said riser contactor for contact with said contact material, said injection means being spaced at different downstream points along said riser contactor, and at least one of said injection means being arranged for introduction of some or all of said heavy petroleum fraction downstream of said reverse bend, an enlarged separation vessel surrounding said downwardly directed discharge opening for separation of vapors from solid contact material bearing a combustible deposit of unvaporized high Conradson Carbon or high metal content constituents of said petroleum fraction, a burner, means to transfer the so separated solid contact material to said burner, air inlet means to said burner for supply of air thereto for combustion of said combustible deposit whereby the temperature of said solid contact material is increased and means to transfer the so heated contact material from said burner to said hot solids standpipe.

* * * * *